US009133668B2

(12) United States Patent
Cardellini et al.

(10) Patent No.: US 9,133,668 B2
(45) Date of Patent: Sep. 15, 2015

(54) WIRELESS TRANSMISSION SYSTEM AND SYSTEM FOR MONITORING A DRILLING RIG OPERATION

(75) Inventors: David A. Cardellini, Spring, TX (US); Matthew D. Becker, Alta Loma, CA (US); Richard Lee Murray, Jr., Foothill Ranch, CA (US)

(73) Assignee: National Oilwell Varco, L.P., Houston, TX (US)

( * ) Notice: Subject to any disclaimer, the term of this patent is extended or adjusted under 35 U.S.C. 154(b) by 249 days.

(21) Appl. No.: 13/375,864

(22) PCT Filed: May 26, 2010

(86) PCT No.: PCT/US2010/036189

§ 371 (c)(1),
(2), (4) Date: Dec. 2, 2011

(87) PCT Pub. No.: WO2010/141287

PCT Pub. Date: Dec. 9, 2010

(65) Prior Publication Data

US 2012/0080227 A1 Apr. 5, 2012

Related U.S. Application Data

(60) Provisional application No. 61/183,282, filed on Jun. 2, 2009.

(51) Int. Cl.
*G01V 3/00* (2006.01)
*E21B 17/00* (2006.01)
(Continued)

(52) U.S. Cl.
CPC ..... *E21B 17/003* (2013.01); *E21B 44/00* (2013.01); *E21B 47/12* (2013.01); *E21B 47/122* (2013.01)

(58) Field of Classification Search
CPC ..... E21B 47/00
USPC ..... 340/853.1, 853.3
See application file for complete search history.

(56) References Cited

U.S. PATENT DOCUMENTS 2,116,120 A * 5/1938 Malmgren ..... 33/313
2,380,520 A * 7/1945 Hassler ..... 367/83
(Continued)

FOREIGN PATENT DOCUMENTS

CA 2761955 12/2010
GB 2352743 A * 2/2001
WO 03/058029 A1 7/2003

OTHER PUBLICATIONS

International Application No. PCT/US2010/036189, Search Report and Written Opinion dated Dec. 30, 2010, 8 pages.
(Continued)

*Primary Examiner* — Amine Benlagsir
(74) *Attorney, Agent, or Firm* — JL Salazar Law Firm

(57) ABSTRACT

A system for monitoring a drilling rig operation includes a drilling rig assembly and at least one sensor coupled to a member of the drilling rig assembly to sense a parameter related to operation of the drilling rig assembly. A client device coupled to the at least one sensor includes a data acquisition device for receiving data from the at least one sensor. The client device also includes a first radio, which is coupled to the data acquisition device. A base station located a distance from the client device comprises a second radio that communicates wirelessly with the first radio in order to transfer data between the data acquisition device and the base station.

42 Claims, 5 Drawing Sheets

(51) Int. Cl.

| | |
|---|---|
| ***E21B 44/00*** | (2006.01) |
| ***E21B 47/12*** | (2012.01) |

(56) References Cited

U.S. PATENT DOCUMENTS

| | | | | | |
|---|---|---|---|---|---|
| 2,639,588 | A * | 5/1953 | Durant et al. | 405/205 |
| 2,676,787 | A * | 4/1954 | Johnson | 175/7 |
| 3,037,295 | A * | 6/1962 | Roberson | 33/312 |
| 3,042,998 | A * | 7/1962 | Sweett et al. | 29/597 |
| 3,109,501 | A * | 11/1963 | Pugh | 175/325.3 |
| 3,279,404 | A * | 10/1966 | Richardson | 114/293 |
| 3,390,654 | A * | 7/1968 | Bromell et al. | 114/264 |
| 3,402,343 | A * | 9/1968 | Brown et al. | 324/303 |
| 3,482,629 | A * | 12/1969 | Suman, Jr. | 166/255.1 |
| 4,491,022 | A * | 1/1985 | de la Cruz | 73/783 |
| 4,616,321 | A | 10/1986 | Chan | |
| 5,144,126 | A | 9/1992 | Perry et al. | |
| 5,155,916 | A * | 10/1992 | Engebretson | 33/302 |
| 6,429,787 | B1 | 8/2002 | Pyne et al. | |
| 6,439,325 | B1 * | 8/2002 | Peters et al. | 175/325.5 |
| 6,956,791 | B2 | 10/2005 | Dopf et al. | |
| 7,108,081 | B2 | 9/2006 | Boyadjieff | |
| 7,591,304 | B2 | 9/2009 | Juhasz et al. | |
| 7,757,759 | B2 | 7/2010 | Jahn et al. | |
| 2001/0049049 | A1 | 12/2001 | Hensley et al. | |
| 2002/0039328 | A1 * | 4/2002 | Dubinsky et al. | 367/82 |
| 2002/0156730 | A1 * | 10/2002 | Newman | 705/40 |
| 2003/0236628 | A1 * | 12/2003 | Martorana et al. | 702/9 |
| 2004/0251048 | A1 | 12/2004 | Kurkoski | |
| 2005/0056461 | A1 | 3/2005 | Estes et al. | |
| 2005/0197777 | A1 * | 9/2005 | Rodney et al. | 702/9 |
| 2006/0219438 | A1 * | 10/2006 | Moore et al. | 175/50 |
| 2007/0017682 | A1 * | 1/2007 | Abrahamsen et al. | 166/379 |
| 2007/0030167 | A1 | 2/2007 | Li et al. | |
| 2007/0215343 | A1 * | 9/2007 | McDonald et al. | 166/105 |
| 2008/0007421 | A1 * | 1/2008 | Liu et al. | 340/853.3 |
| 2008/0033653 | A1 * | 2/2008 | Pabon et al. | 702/6 |
| 2008/0164025 | A1 * | 7/2008 | Peter | 166/255.2 |
| 2008/0202810 | A1 | 8/2008 | Gomez | |
| 2009/0193993 | A1 * | 8/2009 | Hummel et al. | 102/215 |
| 2009/0289808 | A1 * | 11/2009 | Prammer | 340/853.7 |
| 2010/0051292 | A1 * | 3/2010 | Trinh et al. | 166/378 |
| 2010/0193198 | A1 * | 8/2010 | Murray et al. | 166/380 |
| 2010/0224409 | A1 | 9/2010 | Sarhad et al. | |
| 2011/0098931 | A1 * | 4/2011 | Kosmala et al. | 702/12 |
| 2012/0080227 | A1 | 4/2012 | Cardellini et al. | |

OTHER PUBLICATIONS

Besaisow et al., "Application of ADAMS (Advanced Drillstring Analysis and Measurement System) and Improved Drilling Performance," SPE 19998, SPE Annual Technical Conference and Exhibition, Feb. 27-Mar. 2, 1990, Houston, Texas.

Besaisow et al., "Development of a Surface Drillstring Vibration Measurement System," SPE 14327, SPE Annual Technical Conference and Exhibition, Sep. 22-26, 1985, Las Vegas, Nevada.

Noble Corporation, "Instrumented Surface Sub DOE Project (DE-FC26-03NT41782)" [online], [retrieved on Nov. 5, 2012]. Retrieved from the internet <URL: http://www.netl.doe.gov/technologies/oil-gas/publications/EPreports/DCS/Participant%20Presentation.ppt>, pp. 1-12.

National Energy Technology Laboratory, Oil & Natural Gas Projects, Exploration & Production Technologies, "Drilling Optimization Utilizing Surface Instrumentation for Downhole Event Recognition" [online], [retrieved on Nov. 5, 2012]. Retrieved from the internet <URL:http://www.netl.doe.gov/technologies/oil-gas/NaturalGas/Projects_n/EP/DCS/DCS_A_41782DrillOpt.html>, 2 pages.

Cohen, et al. "Drilling Optimization Utilizing Surface Instrumentation for Downhole Event Recognition, Final Report, Sep. 30, 2003 to Dec. 31, 2005," Maurer Technology, Inc., Feb. 2006, 64 pgs.

Canadian Intellectual Property Office, First Office Action, PCT/US2010/36189, Jan. 23, 2013, 3 pages.

Response to Non Final Office Action for Canadian Patent Application No. 2,761,955 dated Jul. 15, 2013, 13 pages.

Examination Report for Canadian Patent Application No. 2,761,955 dated Aug. 5, 2014, 6 pages.

Response to Examination Report for Canadian Patent Application No. 2,761,955 dated Jan. 26, 2015, 16 pages.

* cited by examiner

WIRELESS TRANSMISSION SYSTEM AND SYSTEM FOR MONITORING A DRILLING RIG OPERATION

STATEMENT REGARDING FEDERALLY SPONSORED RESEARCH OR DEVELOPMENT

Not applicable.

BACKGROUND

1. Field of the Invention

The invention relates generally to transmission of data between a drilling rig assembly and a control and acquisition system during a drilling rig operation. More particularly, the invention relates to transmission of data from sensors located on a rotatable or non-rotatable member of a drilling rig assembly to a control and acquisition system during a drilling rig operation.

2. Description of Related Art

Real-time measurement of various parameters related to a drilling rig operation is important to successful execution of the drilling rig operation. A drilling rig assembly may incorporate one or more sensors on one or more members, e.g. a pipe running tool or top drive shaft, for sensing the desired parameters. Data transmission from the sensors typically involves use of electric slip rings or inductive pickup devices, which are not well-suited to the drilling rig environment because they require precise alignment and close tolerances for successful operation.

SUMMARY

In some embodiments, a system for monitoring a drilling rig operation comprises a drilling rig assembly. At least one sensor is coupled to a member of the drilling rig assembly to sense a parameter related to operation of the drilling rig assembly. A client device coupled to the at least one sensor includes a data acquisition device for receiving data from the at least one sensor. The client device also includes a first radio, which is coupled to the data acquisition device. A base station located a distance from the client device includes a second radio that communicates wirelessly with the first radio in order to transfer data between the data acquisition device and the base station.

In other embodiments, a wireless transmission system comprises a client device having a data acquisition device for receiving data from at least one sensor and a first radio coupled to the data acquisition device. The system further includes a base station having a second radio that communicates wirelessly with the first radio in order to transfer data between the data acquisition device and the base station.

In yet other embodiments, a method of monitoring a drilling rig operation comprises sensing a parameter related to the drilling rig operation using at least one sensor coupled to a member of a drilling rig assembly. Data is collected from the at least one sensor using a data acquisition device of a client device coupled to the at least one sensor. The data collected by the data acquisition device is transmitted wirelessly to a base station located at a distance from the data acquisition device using a first radio coupled to the data acquisition device and a second radio coupled to the base station.

The scope of embodiments of the present disclosure will be apparent from the following description and the appended claims.

BRIEF DESCRIPTION OF DRAWINGS

The accompanying drawings, described below, illustrate various exemplary embodiments of the invention and are not to be considered limiting of the scope of the disclosure, for the disclosure may admit to other equally effective embodiments. The figures are not necessarily to scale, and certain features and certain views of the figures may be shown exaggerated in scale or in schematic in the interest of clarity and conciseness.

DETAILED DESCRIPTION

Figure 1:
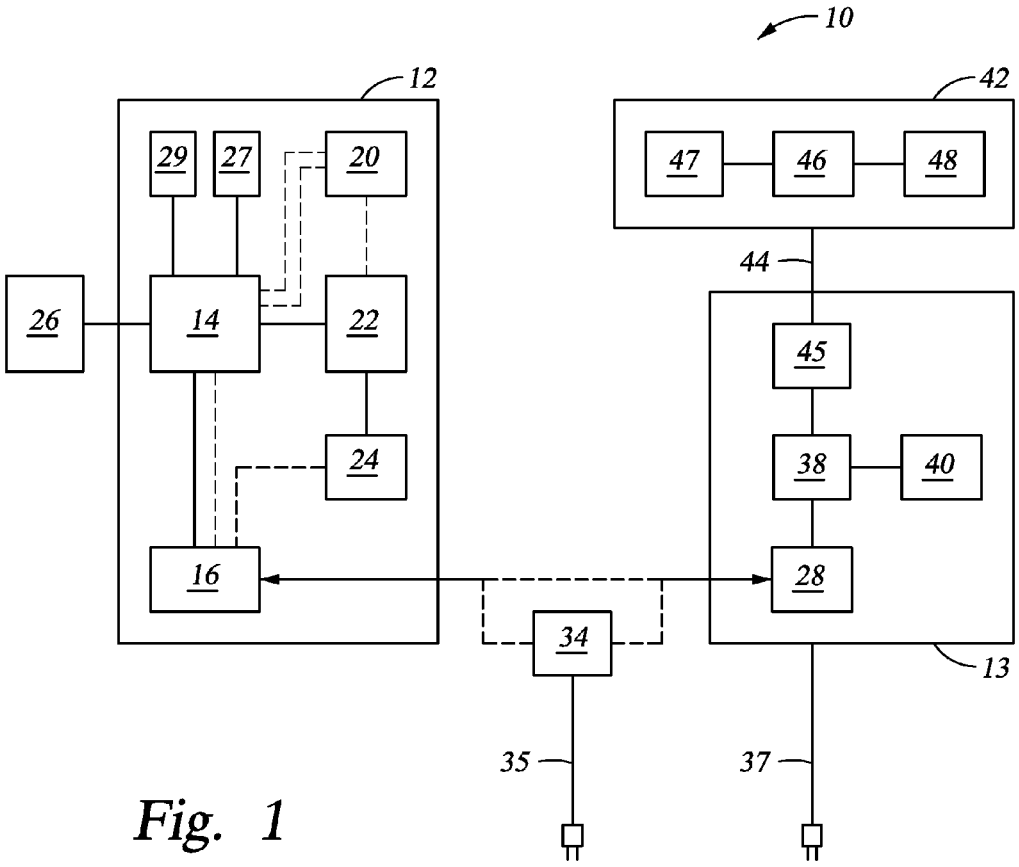
FIG. 1 is a diagram of a wireless transmission system.

FIG. 1 is a diagram of a wireless transmission system 10 including a client device 12, a base station 13, and a control and acquisition system 42. The client device 12 includes a data acquisition device 14, radio 16, and battery 20. The client device 12 may further include processor 22, memory 24, one or more accelerometers 27, e.g., single-axis or multi-axis MEMS ("micro-electro-mechanical systems") accelerometer, and one or more gyroscopes 29, e.g., MEMS gyroscopes. The processor 22 may include, for example, an input/output interface, a clock, a CPU, RAM, and ROM (none of these components are shown separately). The battery 20 powers the components of the client device 12 as needed. Alternatively, as will be explained below, the components of the client device 12 may be powered autonomously by harvested energy.

The client device 12 may also be equipped with redundant sensors for use in a collision avoidance system of drilling assembly tools. Modern drilling rigs use computerized control systems to assist operators in controlling tools on the drilling rig. The many various tools on the drilling rig frequently operate in the same areas at the same time. It is imperative that these tools do not interfere or collide with each other. The control systems use sensors to warn the operators of potential collisions or interference, or to shut down the tools to prevent collisions. A classic example is the driller hoisting a traveling block in a derrick. Sensors are used to tell the driller when the traveling block gets too close to the top of the derrick so that the driller can stop the traveling block before a collision occurs. Or, the drawworks can be shut down automatically and the brake applied to prevent a collision.

The data acquisition device 14 collects data from sensors 26 that monitor parameters related to a drilling operation. As used herein, the term "sensor" refers to any one of a source (that emits or transmits energy or signals), a receiver (that receives or detects energy or signals), and a transducer (that operates as either a source or a receiver). Examples of sensors 26 include, but are not limited to, strain gauges, thermocouples, load cells, and transducers. In use, the sensors 26 are located on a rotatable or non-rotatable member of a drilling rig assembly in order to measure various parameters related to use of the drilling rig assembly. Examples of measurements that could be made by sensors 26 include, but are not limited to, top drive shaft bending moment, top drive torque, top drive tension, drilling rig hoist load, weight-on-bit and other related drilling data, and rotational alignment of downhole tools.

The data acquisition device 14 observes external signal inputs and onboard signal inputs. The external signals may be, for example, signals from the sensors 26. The onboard signals may be, for example, signals from a high-speed counter driven by the clock of the processor 22, the output of the accelerometer 27, the output of the gyroscope 29, and life indicator signal from the battery 20. The data acquisition device 14 samples, filters, and stores data to pre-selected channels. The data acquisition device 14 allows for each channel to have its own unique and user-configurable sample rate, filter type, and storage rate. For example, the output of the accelerometer 27 may be used to catch transients during shock loading, which may use very high sample rates, while the output of the gyroscope 29 may be used to sense whether a member is stationary, which may use very low sample rates relative to the aforementioned accelerometer output. In this instance, the data acquisition device 14 allows for two channels to be configured, one to receive the accelerometer signals at the high sample rates and another to receive the gyroscope signals at the low sample rates. Also, several channels can be activated to monitor the same signal output, where each channel would be with a different sample rate, filter type, and storage rate. For example, the gyroscope 29 may be used to sense whether a member is stationary and to measure the rotational position of the member, the latter may employ a new channel and a higher sample rate and storage rate. In this instance, the data acquisition device 14 allows for two channels to be configured, one to receive the gyroscope signals indicative of whether the member is stationary and another to receive the gyroscope signals indicative of the rotational position of the member. In general, the data acquisition device 14 can allow as many channels as needed to be configured with a specific sample rate, filter type, and storage rate.

Data in the pre-selected channels are transmitted to the base station 13 and/or may be stored in memory 24. Like the sample rate, filter type, and storage rate, the transmission rate for each channel is also unique and user-configurable. This allows for a much more power-efficient monitoring scheme. For example, a signal with a high sample rate and storage rate can be configured to have a low transmission rate, thus reducing the number of transmissions and reducing the amount of power used while still capturing large amounts of data. On the other hand, if the signal has real-time importance, then it can be configured to have a high transmission rate.

Figure 2:
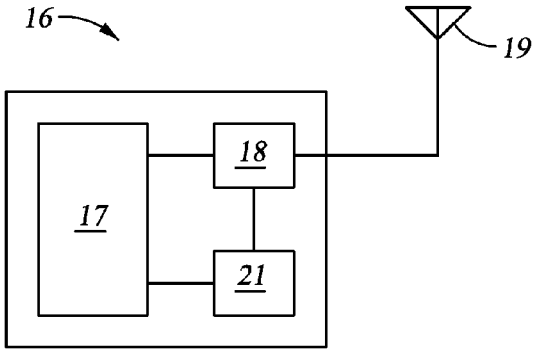
FIG. 2 is a diagram of a radio.

The radio 16 is used to transmit data from the data acquisition device 14 (or memory 24) to the base station 13. In order to conserve energy, the radio 16 is preferably a micro-power radio. On the other hand, micro-power technology can enable the client device 12 to run without a battery. Energy for running the device can be harvested from external sources, captured, and stored and used to run the client device 12. Energy can be harvested from, for example, ambient vibrations, wind, heat or light, which would enable the device to function autonomously and indefinitely. Preferably, the micro-power radio is based on IEEE 802.15.4 standard. In certain aspects, the radio 16 may be a ZigBee radio, which is based on the IEEE 802.15.4 standard. ZigBee technology is used as an example herein and is by no means the only example of a micro-power radio technology that can be used with embodiments of the system 10. As shown in FIG. 2, the ZigBee radio 16 may include a processor 17, a transceiver 18 (or separate transmitter and receiver), an antenna 19, and a direct sequence spread spectrum (DSSS) control 21. Returning to FIG. 1, the base station 13 includes a radio 28 that communicates with the radio 16. The radio 28 may also be a micro-power radio, preferably one based on the IEEE 802.15.4. In certain aspects, the radio 28 may be a ZigBee radio, for example, having a structure similar to the one shown for radio 16 in FIG. 2. The radio 28 may receive power through the power input connection 37 of the base station 13.

A radio 34 may be provided between the client device 12 and the base station 13 to act as a repeater. In certain aspects, the radio 34 may be a micro-power radio. In certain aspects, the radio 34 may be based on IEEE 802.15.4 protocol. In certain aspects, the radio 34 may be a ZigBee radio implementing the IEEE 802.15.4 protocol. In a general mode, data is transmitted between the radio 16 of the client device 12 and the radio 28 of the base station 13. In a repeater mode, data is transmitted between the radio 16 of the client device 12 and the repeater radio 34 and between the repeater radio 34 and the base station 13. The radio 34 may be provided with a power input connection 35 to allow for an external supply of power. Typically, the system 10 operates in the general mode and reserves the repeater mode for backup purposes.

In addition to the radio 28, the base station 13 may have a processor 38 and memory 40. Memory 40 may be used to store data received through the radio 28, while the processor 38 may control operation of the base station 13, e.g., coordinating storage of data into memory 40 after receiving the data through the radio 28. The base station 13 makes the data received from the client device 12 available to a control and acquisition system 42 through a network link 44, which may be wired or wireless. The base station 13 may include an Ethernet interface 45 for connection to the network link 44. The control and acquisition system 42 may include processor 46, memory 47, display device 48, and other peripheral devices as needed for observing the data received from the base station 13.

The following are examples of systems for monitoring a drilling rig operation. The following examples are not intended to limit use of the wireless transmission system as otherwise described above.

Example 1

Figure 3:
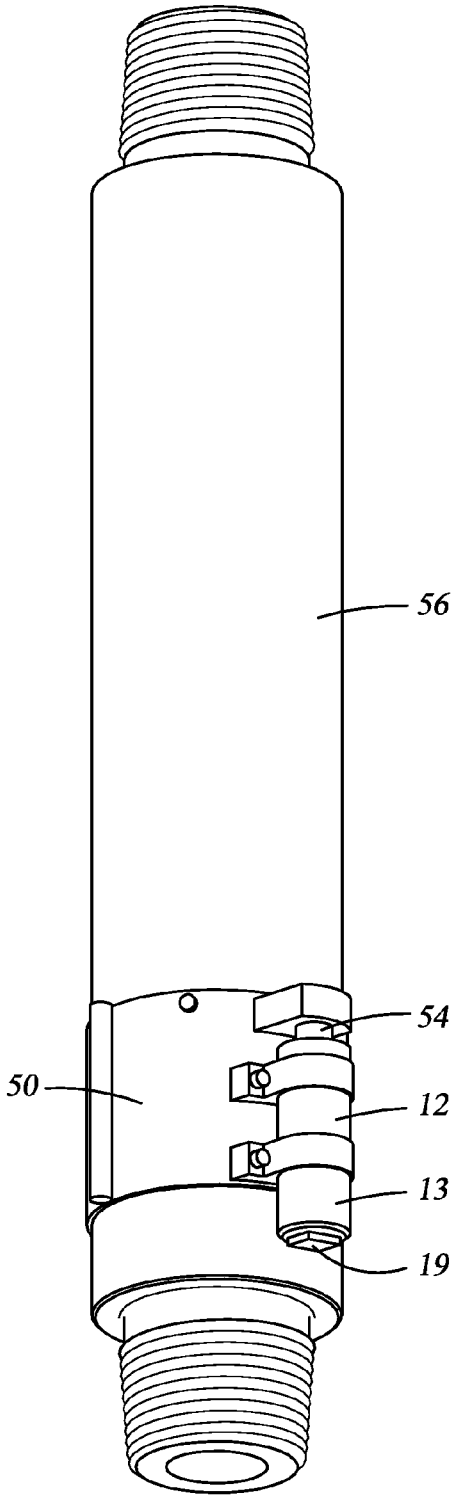
FIG. 3 is a perspective view of the client device of the wireless transmission system of FIG. 1 mounted on an instrumented sub.

FIG. 3 shows the client device 12 mounted on an instrumented sub 56. A cover 50 protects the sensors attached to the instrumented sub 56. A housing 13 containing the components of the client device 12 is fastened to the cover 50. Any suitable means of fastening the housing 13 to the cover 50 may be used. The antenna 19 of the radio (16 in FIG. 2) of the client device 12 is shown as a patch-type antenna. The housing 13 is of a construction suitable for the environment of operation. The housing 13 should generally be rugged, able to withstand high temperatures, and provide a sealed environment for the components contained therein. An electrical connector 54 is provided on the cover 50 for connecting the sensor inputs to the client device 12. The electrical connector 54 may be removable to allow access into the interior of the housing 13, e.g., to allow the battery of the client device 12 to be easily replaced.

Example 2

Figure 4:
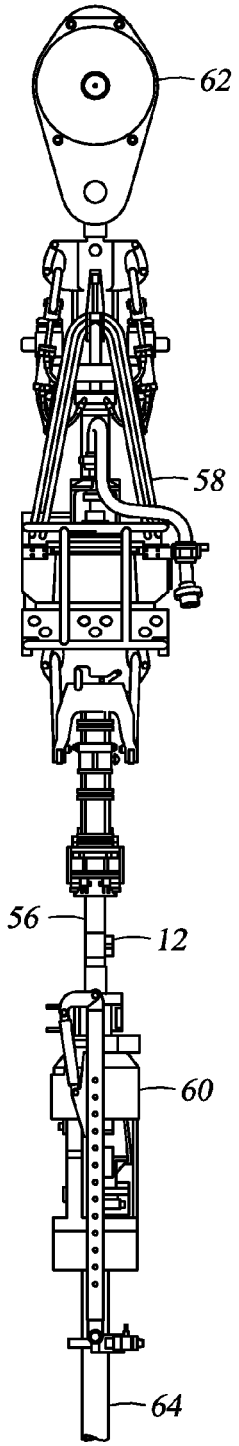
FIG. 4 shows the instrumented sub and client device of FIG. 3 located between a top drive assembly and a pipe running tool.

FIG. 4 shows a system for monitoring transmitted torque in a pipe running tool. In this figure, the instrumented sub 56 of Example 1 connects a top drive assembly 58, hung on a traveling block 62, to a pipe running tool 60. The pipe running tool 60 is designed to assemble pipe strings and includes a pipe engagement assembly (not indicated separately) for engaging a pipe segment 64. The instrumented sub 56 may include strain gauges and other hardware to measure torque transmitted through the shaft of the top drive assembly 58 to the pipe running tool 60. The signals from the instrumented sub 56 are transferred to the client device 12, where they are processed and then sent wirelessly to the base station (13 in FIG. 1) and then on to the control and acquisition system (42 in FIG. 1). The connection for transferring the signals between the instrumented sub 56 and the client device 12 may be an electrical connector (e.g., 54 in FIG. 3), a cable, or any electrical contact device suitable for the environment. The signals collected by the data acquisition device (14 in FIG. 1) of the client device 12 are processed and then transmitted to the base station (13 in FIG. 1), which transmits the signals to the control and acquisition system (42 in FIG. 1). The instrumented sub 56 could be instrumented to read other imposed loads besides torque, such as tension loads and bending loads.

Example 3

Still referring to FIG. 4, the gyroscope (29 in FIG. 1) of the client device 12 measures angular velocity as the pipe running tool 60 rotates. The data acquisition device (14 in FIG. 1) of the client device 12 collects the signals from the gyroscope, processes the signals, and sends the signals wirelessly to the base station (13 in FIG. 1), which then sends the signals to the control and acquisition system (42 in FIG. 1). The signals are integrated to obtain the rotational position of the pipe running tool 60. While the rotational position of the pipe running tool 60 is being measured, the torque applied to the pipe running tool 60 is also measured as in Example 2. The rotational position and the torque information are used to determine the proper makeup of pipe threaded connections. In this example, the gyroscope (29 in FIG. 1) of the client device 12 provides an easy way of measuring pipe connection turns. Alternative devices that can be used to measure pipe connection turns include rotary encoder, proximity switch with target, and any other device that can accurately measure rotational positions. These alternative devices may be used in lieu of, or together with, the gyroscope 29. In one example, a rotary encoder may be used as a backup device to the gyroscope 29. The client device 12 can collect signals from any of these alternate devices and send the signals wirelessly to the control and acquisition system (42 in FIG. 1) via the base station (13 in FIG. 1).

Example 4

This example relates to control of the power usage of the client device 12. Referring to FIG. 1, the gyroscope 29 of the client device 12 assists in controlling the power state of the client device 12 while the client device 12 is coupled to a rotatable member, such as in Examples 1 through 3. The gyroscope 29 outputs a variable signal depending on whether the rotatable member to which the client device 12 is attached is being rotated or not. The signal strength of the gyroscope 29 is used to determine when to power-up or power-down the client device 12. In one implementation, the client device 12 has three power states: a high-power state, a low-power state, and an auto-power state. The high-power state occurs when the gyroscope 29 signal is outside of a predefined threshold band. The low-power state occurs when the gyroscope 29 signal is within the predefined threshold band. The auto-power state is similar to the low-power state but allows the radio 16 to continue to operate in the high-power state for a flexible time period after the gyroscope 29 signal enters the predefined threshold band. The flexible time period can be changed using bidirectional communication between the base station 13 and the client device 12.

Example 5

Figure 5:
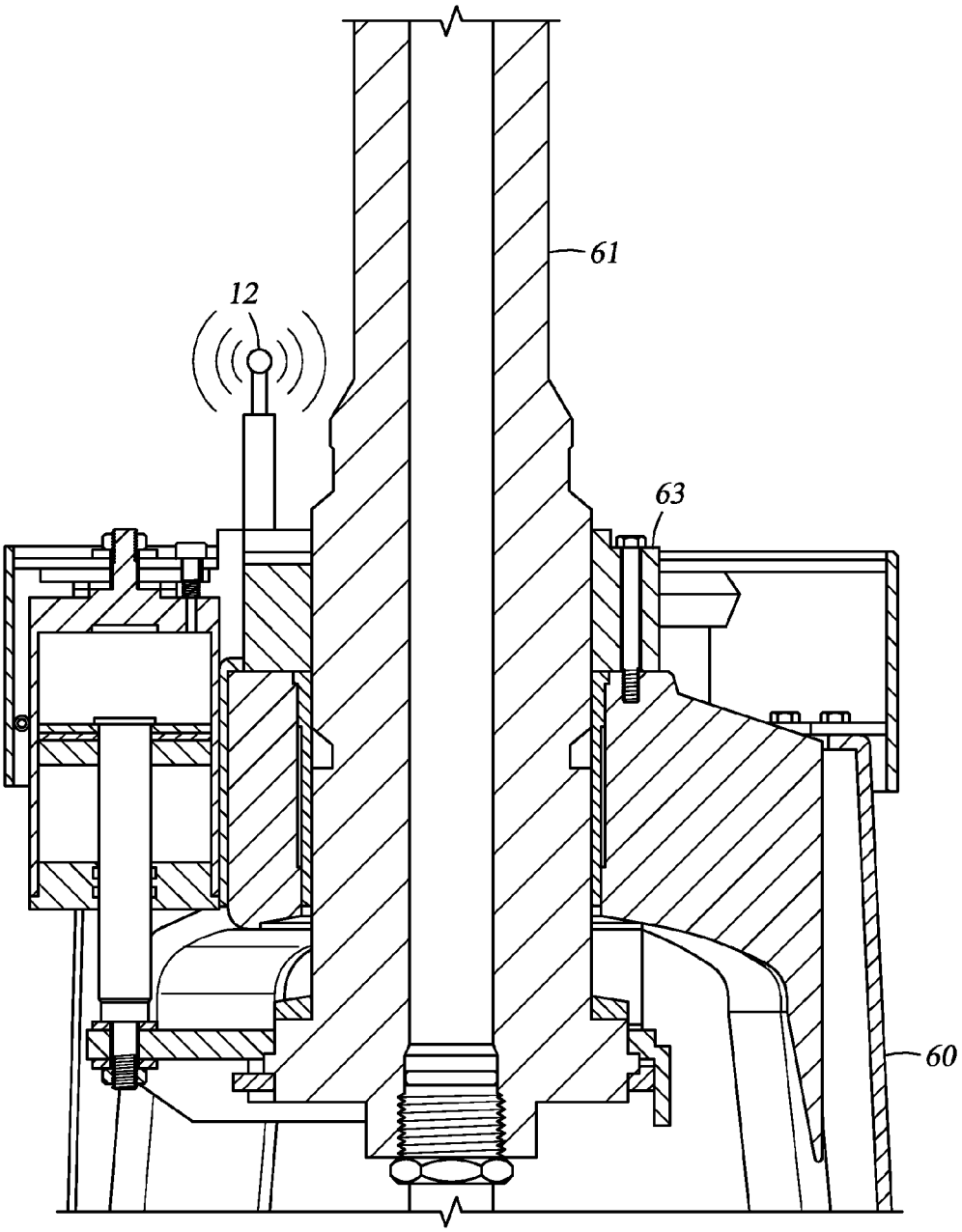
FIG. 5 shows the client device of the wireless transmission system of FIG. 1 mounted on a pipe running tool.

FIG. 5 shows another system for monitoring transmitted torque in the pipe running tool 60 (only the portion of pipe running tool 60 relevant to description of this example is shown). The client device 12 is mounted on the pipe running tool 60 in close proximity to a spline shaft 61 and a spline bushing 63 of the pipe running tool 60. The spline interface between the spline shaft 61 and spline bushing 63 transmits torque. The spline bushing 63 and/or spline shaft 61 are instrumented (e.g., with strain gages) to measure the transmitted torque. The client device 12 is used to collect and transmit the torque measurements wirelessly to the base station (13 in FIG. 1), which in turn transmits the measurements to the control and acquisition system (42 in FIG. 1). Any suitable connection between the client device 12 and the sensors in the spline bushing 63 and/or spline shaft 61 to allow transfer of signals between the sensors and the client device 12 may be used.

Example 6

In this example, the client device (12 in FIG. 1) is mechanically coupled to a rotatable member and data collected by sensors in the client device is used to derive information other than what the sensors were originally designed for. Specifically, data collected from a 3-axis accelerometer is used to both determine an inclination angle and a rotational angle of a top drive link. The inclination angle depends on gravity, but the rotational angle does not depend on gravity. Top drive links are used to suspend an elevator from a top drive (see, e.g., FIG. 8 of U.S. Pat. No. 4,489,794, issued to Boyadjieff). The elevator is provided to support a drill pipe. A link tilt mechanism is coupled to the top drive links to selectively tilt the top drive links and the suspended elevator, e.g., in order to position the elevator over a mousehole.

Figure 6:
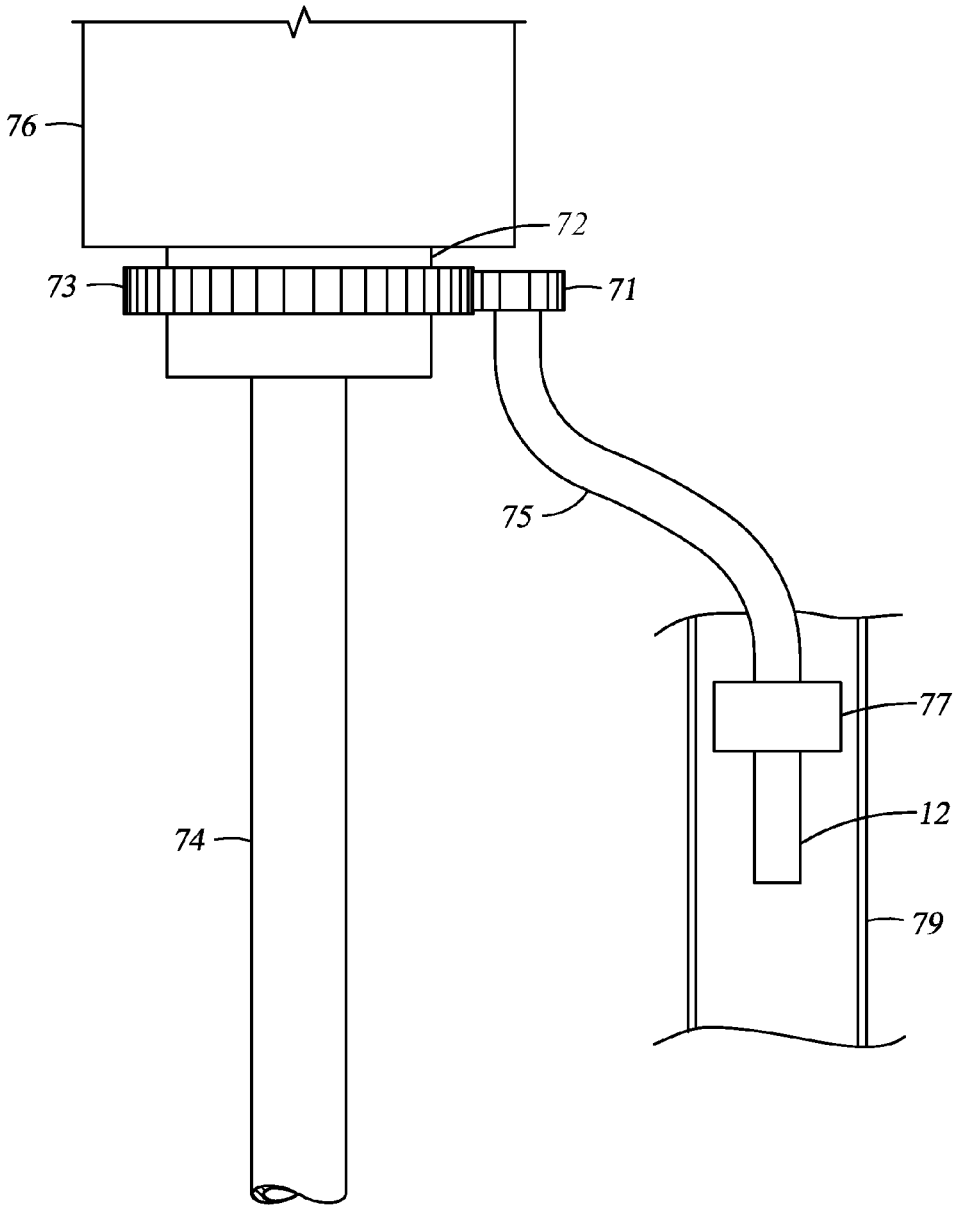
FIG. 6 shows a system for monitoring inclination and rotational angles of a top drive link tilt.

The monitoring setup is shown in FIG. 6. In this figure, a pinion gear 71 with mounting hardware meshes with a rotation gear 73 of a top drive pipe handler 72. The top drive pipe handler 72 is connected to the top drive shaft 74 of the top drive 76. The pinion gear 71 is attached to a flexible cable 75 that transmits rotary motion of the pinion gear 71 to a gear box assembly 77, which is mounted to a link tilt 79. The small box assembly 77 contains a gearbox reduction configured as the reciprocal of the pinion gear 71 and rotation gear 73 ratio. A "gear ratio" is the relationship between the numbers of teeth on two gears that are meshed. The client device 12 is attached to the output of the gearbox reduction 77. The 3-axis accelerometer (27 in FIG. 1), which is a member of the client device 12, will have the same angle as the link tilt 79. The 3-axis accelerometer will rotate about one of its axes once per revolution of the top drive pipe handler. The changing accelerometer signals allow for determination of inclination angle and rotational angle of the link tilt 79. The data acquisition device is configured to extract the inclination and rotational angles from the 3-axis accelerometer data.

In the example above, if the client device 12 is equipped with three 3-axis accelerometers for redundant tilt angle and rotational angle sensing of top drive link tilts, then, should one accelerometer fail, a warning can be issued to schedule maintenance/repair of the device while there are still two remaining accelerometers for data integrity checking and successful collision avoidance monitoring.

Example 7

Figure 7:
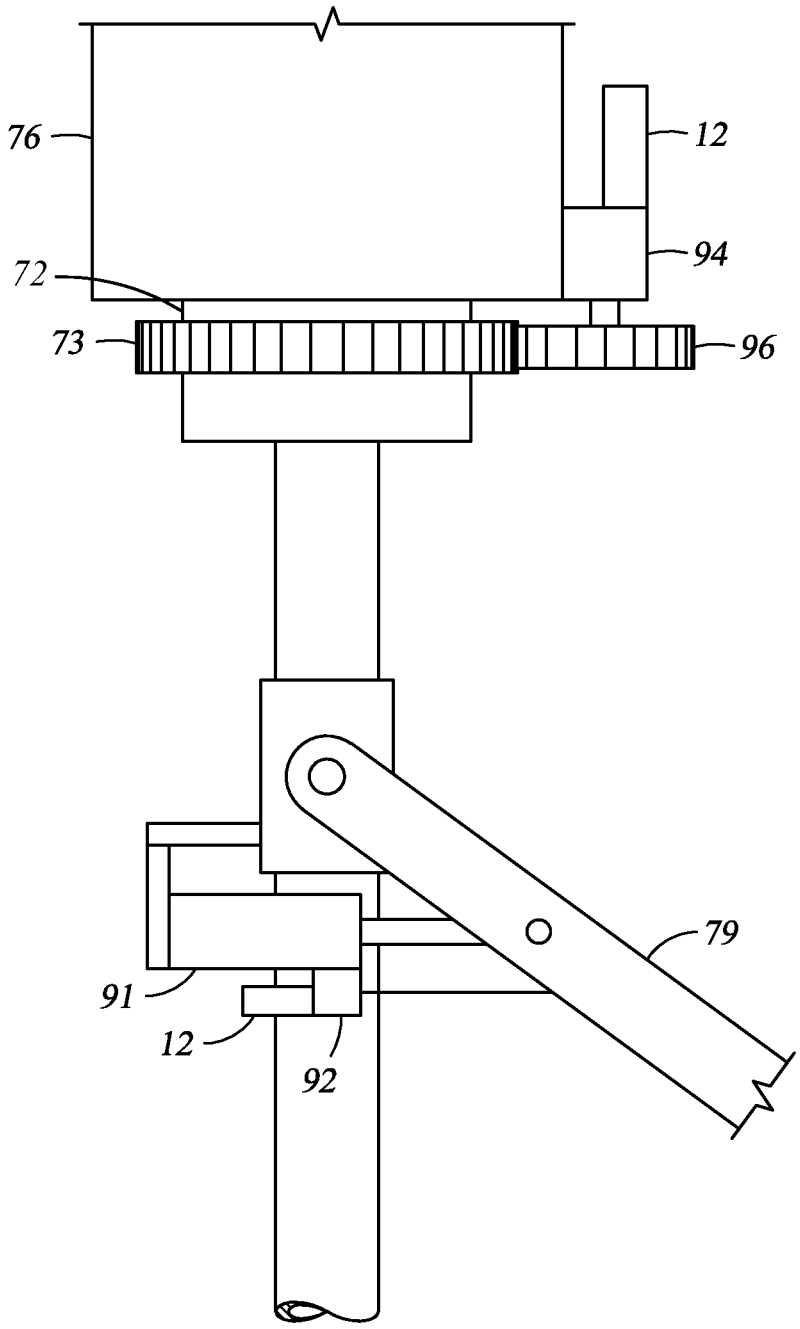
FIG. 7 shows a system for monitoring inclination angle or rotational angle of a top drive link tilt.

Referring to FIG. 7, instead of using an accelerometer as described in Example 6 to measure inclination angle, a power cylinder 91 (such as a hydraulic or pneumatic cylinder) is used. The power cylinder 91 is mechanically coupled to the link tilt arm 79 and instrumented with a stroke measuring instrument 92, e.g. a string potentiometer or other type of linear transducer. As the link tilt arm 79 changes angle, the power cylinder 91 strokes in and out, thus changing the signal generated by the stroke measuring instrument 92. The client device 12 is connected to the stroke measuring instrument 92 to collect the signals or data generated by the stroke measuring instrument 92.

Example 8

Instead of using an accelerometer to measure rotational angle, as described in Example 6, a rotary encoder may be used. Referring to FIG. 7, the rotary encoder 94 is coupled to an encoder drive gear 96, which meshes with the rotation gear 73 of the top drive pipe handler 72. The client device 12 is connected to the rotary encoder 94 to collect the signals or data generated by the rotary encoder 94.

Returning to FIG. 1, the client device 12 provides a very reliable means of transmitting data from sensors located on a rotating member, e.g., casing or pipe running tool or top drive shaft, or a non-rotating member to the base station 13, where the data can then be made available for communication over a network to a control and acquisition system 42. The data acquisition device 14 has a generic and flexible configuration to allow its use in multiple applications and with various data signals. The client device 12 is of rugged configuration and designed for use in the hazardous oilfield environment.

Among the advantages provided by the disclosed techniques is the real-time communication of signals/data during drilling applications. It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks, a CD ROM or other optical disk, a magnetic tape, a read-only memory chip (ROM), and other forms of the kind well-known in the art or subsequently developed. The program of instructions may be "object code," i.e., in binary form that is executable more-or-less directly by the computer; in "source code" that may be compiled or interpreted before execution; or in some intermediate form such as partially compiled code. The precise forms of the program storage device and of the encoding of instructions are immaterial here. Embodiments may be configured to perform the described computing functions (via appropriate hardware/software) on site and/or remotely controlled via an extended communication (e.g., wireless, internet, etc.) network.

While the present disclosure describes various embodiments of a wireless transmission system, numerous modifications and variations will become apparent to those skilled in the art after studying the disclosure, including use of equivalent functional and/or structural substitutes for elements described herein. For example, some embodiments can be implemented for operation in combination with other known telemetry systems (e.g., mud pulse, fiber-optics, wired drill pipe, wireline systems, etc.). The disclosed techniques are not limited to any particular type of conveyance means or oilfield operation. For example, some embodiments are suitable for operations such as logging while drilling (LWD) and measurement while drilling (MWD), logging while tripping, marine operations, and so forth. It is intended that the following claims be interpreted to embrace all such variations and modifications.

What is claimed is:

1. A system for monitoring a drilling rig operation, comprising:

a drilling rig assembly comprising a top drive assembly, the top drive assembly having a member extending therefrom to engage a pipe;

at least one sensor coupled to the member to sense a parameter related to operation of the drilling rig assembly;

a client device coupled to the at least one sensor outside of the member, the client device comprising a data acquisition device that is receiving data from the at least one sensor, and the client device comprising a sensor and a first radio, wherein the first radio is coupled to the data acquisition device, and the client device removably mountable to the member; and a base station located a distance from the client device, and the base station comprising a second radio that communicates wirelessly with the first radio in order to transfer the data between the data acquisition device and the base station;

wherein the client device changes power states based on an output of the at least one sensor, the output comprising rotation of the member of the drilling rig assembly;

wherein an auto-power state occurs when a signal of the client device is within a predefined threshold and allows the first radio to continue to operate in a high-power state for a flexible period of time; and wherein when to power-up or power-down the client device is determined based on a signal strength of the sensor of the client device.

2. The system of claim 1, wherein the first radio is a micropower radio.

3. The system of claim 2, wherein the client device further comprises a gyroscope and the client device further changes the power states based on an output of the gyroscope.

4. The system of claim 1, further comprising a control and acquisition system in communication with the base station.

5. The system of claim 1, wherein the client device further comprises at least one accelerometer.

6. The system of claim 5, wherein the member of the drilling rig assembly is a top drive link tilt, and the data acquisition device further receives first data from the at least one accelerometer.

7. The system of claim 6, wherein the data acquisition device further extracts inclination angle and rotational angle of the top drive link tilt from the first data received from the at least one accelerometer.

8. The system of claim 5, wherein the client device is part of a collision avoidance system, and the at least one accelerometer is for collision avoidance monitoring.

9. The system of claim 1, wherein the client device further has a plurality of configurable channels, each channel of the plurality of configurable channels being assigned to monitor the data from the at least one sensor.

10. The system of claim 1, wherein the client device is further removably mountable onto an instrument sub.

11. The system of claim 1, wherein the client device is further removably mountable on a pipe running tool.

12. The system of claim 1, wherein the client device is further coupled to a rotatable member operatively connectable to a top drive link.

13. The system of claim 1, wherein the client device is further coupled to a link tilt arm of the drilling rig assembly.

14. The system of claim 1, wherein the client device is further operatively connectable to a top drive pipe handler.

15. The system of claim 1, wherein the data is transmitted at a low transmission rate reducing an amount of power used or if the signal of the client device has real-time importance at a high transmission rate.

16. The system of claim 1, further comprising a gyroscope to measure a rotational position of the member and to change the power states based on an output of the gyroscope.

17. The system of claim 16, wherein the client device further comprising a low-power state.

18. The system of claim 17, wherein the high-power state occurs when a gyroscope signal is outside of the predefined threshold and wherein the low-power state occurs when the gyroscope signal is within the predefined threshold.

19. The system of claim 17, wherein the auto-power state occurs when a gyroscope signal is within of the predefined threshold and allows the first radio to continue to operate in the high-power state for the flexible period of time.

20. The system of claim 19, wherein the flexible period of time is changeable via bidirectional communication between the base station and the client device.

21. A wireless transmission system, comprising:

a client device comprising a sensor and a data acquisition device, wherein the data acquisition device is receiving data from at least one sensor, and a first radio coupled to the data acquisition device, wherein the client device removably mountable to a member of a drilling rig assembly, the drilling rig assembly comprising a top drive assembly having the member extending therefrom to engage a pipe, the client device and the at least one sensor mounted outside of the member; and a base station located a distance from the client device, and the base station comprising a second radio that communicates wirelessly with the first radio in order to transfer the data between the data acquisition device and the base station;

wherein the client device changes power states based on an output of the at least one sensor, the output comprising rotation of the member of the drilling rig assembly;

wherein an auto-power state of the client device occurs when a signal of the client device is within a predefined threshold and allows the first radio to continue to operate in a high-power state of the client device for a flexible period of time; and wherein when to power-up or power-down the client device is determined based on a signal strength of the sensor.

22. The wireless transmission system of claim 21, wherein the first radio and the second radio communicate using IEEE 802.15.4 standard.

23. The wireless transmission system of claim 21, wherein the first radio is a micro-power radio.

24. The wireless transmission system of claim 23, wherein the client device is powered by a battery.

25. The wireless transmission system of claim 23, wherein the client device is powered by harvested energy.

26. The wireless transmission system of claim 23, wherein the client device further comprises a gyroscope to detect a rotational speed of the client device.

27. The wireless transmission system of claim 26, wherein the client device further changes the power states based on an output of the gyroscope.

28. The wireless transmission system of claim 21, wherein the data acquisition device further receives first data selected from top drive shaft bending moment, top drive shaft torque data, top drive shaft tension data, drilling rig hoist load data, weight-on-bit data, drilling data, and tool rotational alignment data.

29. The wireless transmission system of claim 21, wherein the data acquisition device further receives second data from at least one auxiliary tool measuring at least one parameter selected from torque, tension, bending moment, rotational velocity, rotational position, and acceleration.

30. The wireless transmission system of claim 21, wherein the client device further comprises at least one accelerometer.

31. The wireless transmission system of claim 30, wherein the client device further catches transients during shock loading based on an output of the at least one accelerometer.

32. The wireless transmission system of claim 21, further comprising a control and acquisition system in communication with the base station.

33. The wireless transmission system of claim 21, further comprising a repeater radio for relaying the data between the first radio and the second radio.

34. The wireless transmission system of claim 21, wherein the client device further having a plurality of configurable channels, each channel of the plurality of configurable channels being assigned to monitor the data from the at least one sensor.

35. The wireless transmission system of claim 34, wherein said each channel of the plurality of configurable channels further includes an individually settable sampling rate for acquiring the data from the at least one sensor by said each channel of the plurality of configurable channels that is assigned to monitor.

36. The wireless transmission system of claim 34, wherein said each channel of the plurality of configurable channels further includes a configurable transmission rate for transmitting to the base station.

37. The system of claim 21, further comprising a gyroscope to sense the rotation of the member and to change the power states when the member is rotated.

38. A method of monitoring a drilling rig operation, comprising:

sensing a parameter related to the drilling rig operation using at least one sensor coupled to a member of a drilling rig assembly, the drilling rig assembly comprising a top drive assembly having the member extending therefrom to engage a pipe;

removably mounting a client device, wherein the client device comprising a sensor, a data acquisition device and a first radio to the member, wherein the client device and the at least one sensor mounted outside of the member;

collecting data from the at least one sensor using the data acquisition device of the client device coupled to the at least one sensor;

determining when to power-up or power-down the client device based on a signal strength of the sensor;

changing a power state of the client device based on an output of the at least one sensor, the output comprising rotation of the member of the drilling rig assembly, an auto-power state of the client device occurring when a signal of the client device is within a predefined threshold and allowing the first radio to continue to operate in a high-power state of the client device for a flexible period of time; and transmitting the data collected by the data acquisition device wirelessly to a base station located at a distance from the data acquisition device using the first radio coupled to the data acquisition device and a second radio coupled to the base station.

39. The method of claim 38, wherein the changing the power state further comprises controlling the power state of the client device.

40. The method of claim 38, wherein the changing the power state further comprises selectively transmitting the data at a low transmission rate reducing an amount of power or, if the signal has real-time importance, then configuring the signal to have at a high transmission rate.

41. The method of claim 38, further comprising measuring a rotational position of the member and further comprising changing the power state of the client device is based on an output of a gyroscope.

42. The method of claim 41, further comprising determining when to power-up or power-down the client device based on a signal strength of the gyroscope.

* * * * *